United States Patent [19]

Schmid

[11] 4,159,237

[45] Jun. 26, 1979

[54] COAL LIQUEFACTION PROCESS EMPLOYING FUEL FROM A COMBINED GASIFIER

[75] Inventor: Bruce K. Schmid, Denver, Colo.

[73] Assignee: Gulf Oil Corporation, Pittsburgh, Pa.

[21] Appl. No.: 905,298

[22] Filed: May 12, 1978

[51] Int. Cl.[2] ..... C10G 1/06; C10J 3/16

[52] U.S. Cl. ..... 208/10; 48/197 R; 48/202; 48/210; 208/8 LE; 260/449 M; 260/449.5

[58] Field of Search ..... 48/197 R, 210, 202, 48/206; 208/8, 10; 252/373; 260/449 M, 449.5; 423/648, 650

[56] References Cited

U.S. PATENT DOCUMENTS

| | | | |
|---|---|---|---|
| 3,769,197 | 10/1973 | Leas et al. | 208/8 |
| 3,847,567 | 11/1974 | Kalina et al. | 48/202 |
| 4,039,424 | 8/1977 | Hyde et al. | 208/8 |
| 4,075,079 | 2/1978 | Lang | 208/8 |
| 4,081,253 | 3/1978 | Marion | 48/197 R |

OTHER PUBLICATIONS

The SRC-II Process, Third Annual Int. Conf. on Coal Gasif. and Liq., Univ. of Pitt., Aug. 3-5, 1976, Schmid et al.

Clean Fuels from Coal Symposium Papers, IGT, Sep. 10-14, 1973, "An Overview of Coal Conversion Technology", Waterman, pp. 673-684.

*Primary Examiner*—S. Leon Bashore
*Assistant Axaminer*—Peter F. Kratz

[57] ABSTRACT

Conversion of raw coal to distillate liquid and gaseous hydrocarbon products by solvent liquefaction in the presence of molecular hydrogen employing recycle of mineral residue is commonly performed at a higher thermal efficiency than conversion of coal to pipeline gas in a gasification process employing partial oxidation and methanation reactions. The prior art has disclosed a combination coal liquefaction-gasification process employing recycle of mineral residue to the liquefaction zone wherein all the normally solid dissolved coal produced in the liquefaction zone is passed to a gasification zone for conversion to hydrogen, where the amount of normally solid dissolved coal passed to the gasification zone is just sufficient to enable the gasification zone to produce the process hydrogen requirement. An unexpected improvement in the thermal efficiency of the combination process is achieved by increasing the amount of normally solid dissolved coal prepared in the liquefaction zone and passed to the gasification zone to enable the gasification zone to generate not only all of the hydrogen required by the liquefaction zone but also to produce excess synthesis gas for use as process fuel. The gasification zone operates with steam and oxygen injection rates resulting in elevated temperatures in the range 2,200° to 2,600° F. which enhance thermal efficiency by accomplishing nearly complete oxidation of carbonaceous feed. These high temperatures produce a synthesis gas relatively richer in CO than $H_2$. Because the synthesis gas is utilized as fuel, hydrogen can be recovered from the synthesis gas without degrading the value of the remaining CO-concentrated stream, since the combustion heating value of a concentrated CO stream is about the same as that of an $H_2$-rich synthesis gas.

21 Claims, 2 Drawing Figures

COAL LIQUEFACTION PROCESS EMPLOYING FUEL FROM A COMBINED GASIFIER

Figure 1:
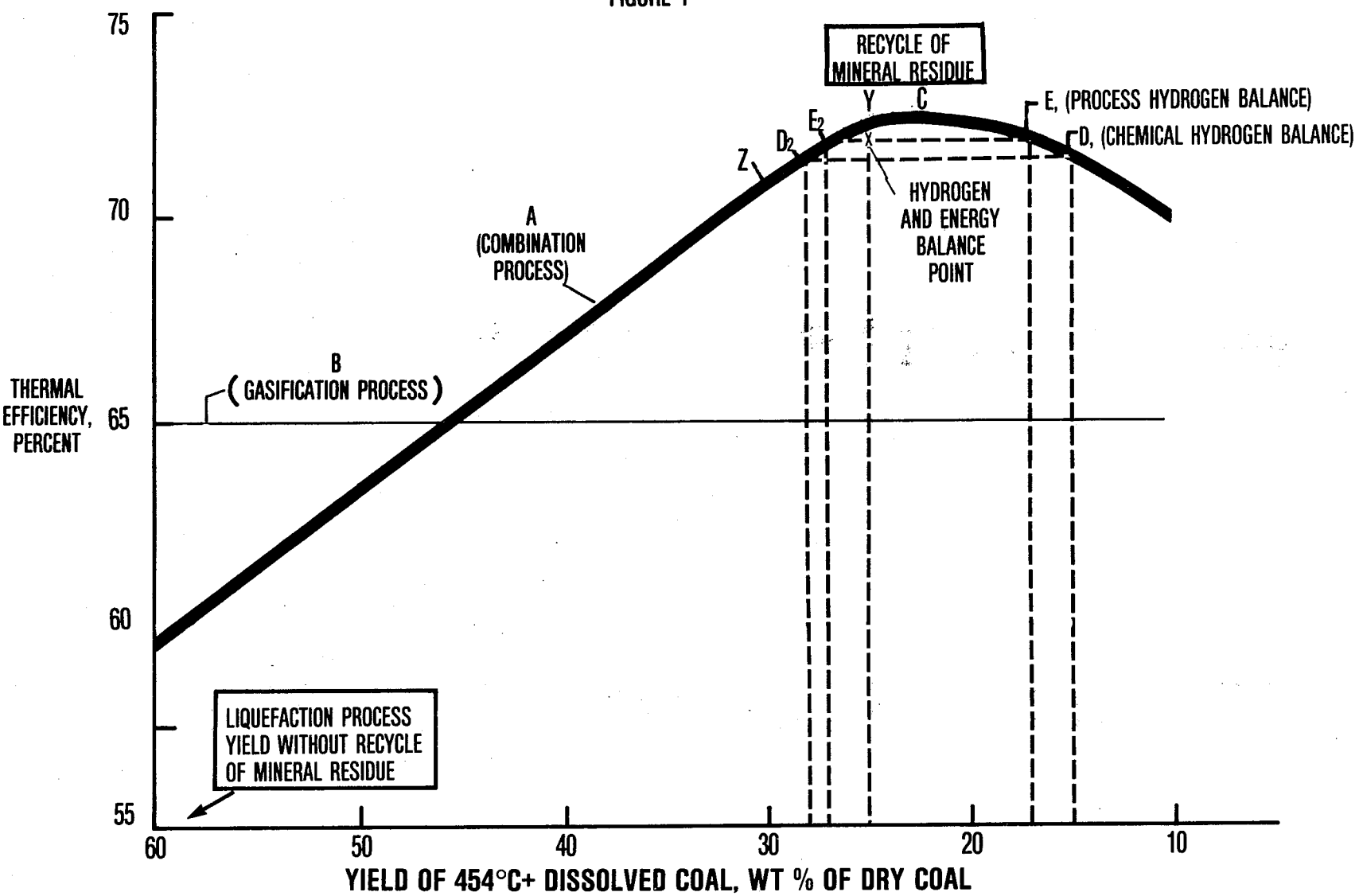

This invention relates to a process wherein coal liquefaction and oxidation gasification operations are combined synergistically to provide an elevated thermal efficiency. The coal feed of the present process can comprise bituminous or subbituminous coals or lignites.

The liquefaction zone of the present process comprises an endothermic preheating step and an exothermic dissolving step. The temperature in the dissolver is higher than the maximum preheater temperature because of the hydrogenation and hydrocracking reactions occurring in the dissolver. Residue slurry from the dissolver or from any other place in the process containing liquid solvent and normally solid dissolved coal and suspended mineral residue is recirculated through the preheater and dissolver steps. Gaseous hydrocarbons and liquid hydrocarbonaceous distillate are recovered from the liquefaction zone product separation system. The portion of the dilute mineral-containing residue slurry from the dissolver which is not recycled is passed to atmospheric and vacuum distillation towers. All normally liquid and gaseous materials are removed overhead in the towers and are therefore substantially mineral-free while concentrated mineral-containing residue slurry is recovered as vacuum tower bottoms (VTB). Normally liquid coal is referred to herein by the terms "distillate liquid" and "liquid coal", both terms indicating dissolved coal which is normally liquid at room temperature, including process solvent. The concentrated slurry contains all of the inorganic mineral matter and all of the undissolved organic material (UOM), which together is referred to herein as "mineral residue". The amount of UOM will always be less than 10 or 15 weight percent of the feed coal. The concentrated slurry also contains the 850° F.+ (454° C.+) dissolved coal, which is normally solid at room temperature, and which is referred to herein as "normally solid dissolved coal". This slurry is passed in its entirety without any filtration or other solids-liquid separation step and without a coking or other step to destroy the slurry, to a partial oxidation gasification zone adapted to receive a slurry feed, for conversion to synthesis gas, which is a mixture of carbon monoxide and hydrogen. The slurry is the only carbonaceous feed supplied to the gasification zone. An oxygen plant is provided to remove nitrogen from the oxygen supplied to the gasifier so that the synthesis gas produced is essentially nitrogen-free.

A portion of the synthesis gas is subjected to the shift reaction to convert it to hydrogen and carbon dioxide. The carbon dioxide, together with hydrogen sulfide, is then removed in an acid gas removal system. Essentially all of the gaseous hydrogen-rich stream so produced is utilized in the liquefaction process. It is a critical feature of this invention that more synthesis gas is produced than is converted to a hydrogen-rich stream. At least 60, 70 or 80 mol percent of this excess portion of the synthesis gas is burned as fuel within the process so that at least 60, 70 or 80 percent, up to 100 percent, of the heat content thereof, is recovered via combustion within the process. Synthesis gas which is burned as fuel within the process is not subjected to a methanation step or to any other hydrogen-consuming reaction, such as the production of methanol, prior to combustion within the process. The amount of this excess synthesis gas which is not utilized as fuel within the process will always be less than 40, 30 or 20 percent thereof and can be subjected to a methanation step or to a methanol conversion step. Methanation is a process commonly employed to increase the heating value of synthesis gas by converting carbon monoxide to methane. In accordance with this invention, the quantity of hydrocarbonaceous material entering the gasifier in the VTB slurry is controlled at a level not only adequate to produce by partial oxidation and shift conversion reactions the entire process hydrogen requirement for the liquefaction zone, but also sufficient to produce synthesis gas whose total combustion heating value is adequate to supply on a heat basis between 5 and 100 percent of the total energy required for the process, such energy being in the form of fuel for the preheater, steam for pumps, in-plant generated or purchased electrical power, etc.

Within the context of this invention, energy consumed within the confines of the gasifier zone proper is not considered to be process energy consumption. All the carbonaceous material supplied to the gasifier is considered to be gasifier feed, rather than fuel. Although the gasifier feed is subjected to partial oxidation the oxidation gases are reaction products of the gasifier, and not flue gas. Of course, the energy required to produce steam for the gasifier is considered to be process energy consumption because this energy is consumed outside of the confines of the gasifier. It is an advantageous feature of the process of this invention that the gasifier steam requirement is relatively low for reasons presented below.

Any process energy not derived from the synthesis gas produced in the gasifier is supplied directly from selected nonpremium gaseous and/or liquid hydrocarbonaceous fuels produced within the liquefaction zone, or from energy obtained from a source outside of the process, such as from electrical energy, or from both of these sources. The gasification zone is entirely integrated into the liquefaction operation since the entire hydrocarbonaceous feed for the gasification zone is derived from the liquefaction zone and all or most of the gaseous product from the gasification zone is consumed by the liquefaction zone, either as reactant or as fuel.

The severity of the hydrogenation and hydrocracking reactions occurring in the dissolver step of the liquefaction zone is varied in accordance with this invention to optimize the combination process on a thermal efficiency basis, as contrasted to the material balance mode of operation of the prior art. The severity of the dissolver step is established by the temperature, hydrogen pressure, residence time and mineral residue recycle rate. Operation of the combination process on a material balance basis is an entirely different operational concept. The process is operated on a material balance basis when the quantity of hydrocarbonaceous material in the feed to the gasifier is tailored so that the entire gasifier synthesis gas can produce, following shift conversion, a hydrogen-rich stream containing the precise process hydrogen requirement of the combination process. Optimization of the process on a thermal efficiency basis requires process flexibility so that the output of the gasifier will supply not only the full process hydrogen requirement but also a significant portion or all of the energy requirement of the liquefaction zone. In addition to supplying the full process hydrogen requirement via the shift reaction, the gasifier produces sufficient excess synthesis gas which when burned directly supplies at least about 5, 10, 20, 30 or 50 and up to 100 percent on a heat basis of the total energy requirement of the process, including electrical or other purchased energy, but excepting heat generated in the gasifier. At least 60, 70, 80 or 90 mol percent of the total $H_2$ plus CO content of the synthesis gas, on an aliquot or non-aliquot basis of $H_2$ and CO, and up to 100 percent, is burned as fuel in the process without methanation or other hydrogenative conversion. Less than 40 percent of it, if it is not required as fuel in the process, can be methanated and used as pipeline gas. Even though the liquefaction process is ordinarily more efficient than the gasification process, and the following examples show that shifting a portion of the process load from the liquefaction zone to the gasification zone to produce methane results in a loss of process efficiency, which was expected; the following examples now surprisingly show that shifting a portion of the process load from the liquefaction zone to the gasification to produce synthesis gas for combustion within the process unexpectedly increases the thermal efficiency of the combination process.

The prior art has previously disclosed the combination of coal liquefaction and gasification on a hydrogen material balance basis. An article entitled "The SRC-II Process—Presented at the Third Annual International Conference on Coal Gasification and Liquefaction, University of Pittsburgh", Aug. 3-5, 1976, by B. K. Schmid and D. M. Jackson stresses that in a combination coal liquefaction-gasification process the amount of organic material passed from the liquefaction zone to the gasification zone should be just sufficient for the production of the hydrogen required for the process. The article does not suggest the passage of energy as fuel between the liquefaction and gasification zones and therefore had no way to realize the possiblity of efficiency optimization as illustrated in FIG. 1, discussed below. The discussion of FIG. 1 shows that efficiency optimization requires the passage of energy as fuel between the zones and cannot be achieved through a hydrogen balance without the passage of energy.

Because the VTB contains all of the mineral-residue of the process in slurry with all normally solid dissolved coal produced in the process, and because the VTB is passed in its entirety to the gasifier zone, no step for the separation of mineral residue from dissolved coal, such as filtration, settling, gravity solvent-assisted settling, solvent extraction of hydrogen-rich compounds from hydrogen-lean compounds containing mineral residue, centrifugation or similar step is required. Also, no mineral residue drying, normally solid dissolved coal cooling and handling steps, or delayed or fluid coking steps are required in the combination process. Elimination or avoidance of each of these steps considerably improves the thermal efficiency of the process.

Recycle of a portion of the mineral residue-containing slurry through the liquefaction zone increases the concentration of mineral residue in the dissolver step. Since the inorganic mineral matter in the mineral residue is a catalyst for the hydrogenation and hydrocracking reactions occurring in the dissolver step and is also a catalyst for the conversion of sulfur to hydrogen sulfide and for the conversion of oxygen to water, dissolver size and residence time is diminished due to mineral recycle, thereby making possible the high efficiency of the present process. Recycle of mineral residue of itself can advantageously reduce the yield of normally solid dissolved coal by as much as about one-half, thereby increasing the yield of more valuable liquid and hydrocarbon gaseous products and reducing the feed to the gasifier zone. Because of mineral recycle, the process is rendered autocatalytic and no external catalyst is required, further tending to enhance the process efficiency. It is a particular feature of this invention that recycle solvent does not require hydrogenation in the presence of an external catalyst to rejuvenate its hydrogen-donor capabilities.

Since the reactions occurring in the dissolver are exothermic, high process efficiency requires that the dissolver temperature be permitted to rise at least about 20°, 50°, 100° or even 200° F. (11.1°, 27.8°, 55.5° or even 111° C.), or more, above the maximum preheater temperature. Cooling of the dissolver to prevent such a temperature differential would require production of additional quench hydrogen in the shift reaction, or would require additional heat input to the preheat step to cancel any temperature differential between the two zones. In either event, a greater proportion of the coal would be consumed within the process, thereby tending to reduce the thermal efficiency of the process.

All of the raw feed coal supplied to the combination process is supplied to the liquefaction zone, and none is supplied directly to the gasification zone. The mineral residue-containing VTB slurry comprises the entire hydrocarbonaceous feed to the gasifier zone. A liquefaction process can operate at a higher thermal efficiency than a gasification process at moderate yields of solid dissolved coal product. Part of the reason that a gasification process has a lower efficiency is that a partial oxidation gasification process produces synthesis gas (CO and $H_2$) and requires either a subsequent shift reaction step to convert the carbon monoxide with added steam to hydrogen, if hydrogen is to be the ultimate gaseous product, or a subsequent shift reaction and methanation step, if pipeline gas is to be the ultimate gaseous product. A shift reaction step is required prior to a methanation step to increase the ratio of CO to $H_2$ from about 0.6 to about 3 to prepare the gas for methanation. Passage of the entire raw coal feed through the liquefaction zone allows conversion of some of the coal components to premium products at the higher efficiency of the liquefaction zone prior to passage of non-premium normally solid dissolved coal to the gasification zone for conversion at a lower efficiency.

According to the above-cited prior art combination coal liquefaction-gasification process, all of the synthesis gas produced is passed through a shift reactor to produce the precise quantity of process hydrogen required. Therefore, the prior art process is subject to the confines of a rigid material balance. However, the present invention releases the process of the rigidity of precise material balance control by providing the gasifier with more hydrocarbonaceous material than is required for producing process hydrogen. The synthesis gas produced in excess of the amount required for the production of hydrogen is removed from the gasification system, for example, from the point between the partial oxidation zone and the shift reaction zone. All, or at least 60 percent, on a combustion heating value basis of the removed portion, after treatment for the removal of acid gas, is utilized as fuel for the process without a methanation step or other hydrogenation step. An amount always below 40 percent of the removed portion, if any, can be passed through a shift reactor to produce excess hydrogen for sale, methanated and utilized as pipeline gas, or can be converted to methanol or other fuel. Thereby, all or most of the output of the gasifier is consumed within the process, either as a reactant or as a source of energy. Any remaining fuel requirements for the process are supplied by fuel produced in the liquefaction process and by energy supplied from a source outside of the process.

The utilization of synthesis gas or a carbon monoxide-rich stream as a fuel within the liquefaction process is a critical feature of the present invention and contributes to the high efficiency of the process. Synthesis gas or a carbon monoxide-rich stream is not marketable as commercial fuel because its carbon monoxide content is toxic, and because it has a lower heating value than methane. However, neither of these objections to the commercial use of synthesis gas or carbon monoxide as a fuel applies in the process of the present invention. First, because the plant of the present process already contains a synthesis gas unit, it is equipped with means for protection against the toxicity of carbon monoxide. Such protection would be unlikely to be available in a plant which does not produce synthesis gas. Secondly, because the synthesis gas is employed as fuel at the plant site, it does not require transport to a distant location. The pumping costs of pipeline gas are based on gas volume and not on heat content. Therefore, on a heating value basis the pumping cost for transporting synthesis gas or carbon monoxide would be much higher than for the transport of methane. But because synthesis gas or carbon monoxide is utilized as a fuel at the plant site in accordance with this invention, transport costs are not significant. Since the present process embodies on site utilization of synthesis gas or carbon monoxide as fuel without a methanation or other hydrogenation step, a thermal efficiency improvement is imparted to the process. It is shown below that the thermal efficiency advantage achieved is diminished or lost if an excessive amount of synthesis gas is methanated and utilized as pipeline gas. It is also shown below that if synthesis gas is produced by the gasifier in an amount in excess of that required for process hydrogen, and all of the excess synthesis gas is methanated, there is a negative effect upon thermal efficiency by combining the liquefaction and gasification processes.

The thermal efficiency of the present process is enhanced because between 5 and 100 percent of the total energy requirement of the process, including both fuel and electrical energy, is satisfied by direct combustion of synthesis gas produced in the gasification zone. It is surpising that the thermal efficiency of a liquefaction process can be enhanced by gasification of the normally solid dissolved coal obtained from the liquefaction zone, rather than by further conversion of said coal within the liquefaction zone, since coal gasification is known to be a less efficient method of coal conversion than coal liquefaction. Therefore, it would be expected that putting an additional load upon the gasification zone, by requiring it to produce process energy in addition to process hydrogen, would reduce the efficiency of the combination process. Furthermore, it would be expected that it would be especially inefficient to feed to a gasifier a coal that has already been subjected to hydrogenation, as contrasted to raw coal, since the reaction in the gasifier zone is an oxidation reaction. In spite of these observations, it has been unexpectedly found that the thermal efficiency of the present combination process is increased when the gasifier produces all or a significant amount of process fuel, as well as process hydrogen. The present invention demonstrates that in a combination coal liquefaction-gasification process the shifting of a portion of the process load from the more efficient liquefaction zone to the less efficient gasification zone in the manner and to the extent described can unexpectedly provide a more efficient combination process.

In order to embody the discovered thermal efficiency advantage of the present invention, the combination coal liquefaction-gasification plant must be provided with conduit means for transporting a portion of the synthesis gas produced in the partial oxidation zone to one or more combustion zones within the process provided with means for the combustion of synthesis gas. First, the synthesis gas is passed through an acid gas removal system for the removal of hydrogen sulfide and carbon dioxide therefrom. The removal of hydrogen sulfide is required for environmental reasons, while the removal of carbon dioxide upgrades the heating value of the synthesis gas and permits finer temperature control in a burner utilizing the synthesis gas as a fuel. To achieve the demonstrated improvement in thermal efficiency, the synthesis gas must be passed to the combustion zone without any intervening synthesis gas methanation or other hydrogenation step.

A feature of this invention is that high gasifier temperatures in the range of 2,200° to 3,600° F. (1,204° to 1,982° C.) are employed. These high temperature improve process efficiency by encouraging the gasification of essentially all the carbonaceous feed to the gasifier. These high gasifier temperatures are made possible by proper adjustment and control of rates of injection of steam and oxygen to the gasifier. The steam rate influences the endothermic reaction of steam with carbon to produce CO and $H_2$, while the oxygen rate influences the exothermic reaction of carbon with oxygen to produce CO. Because of the high temperatures indicated above, the synthesis gas produced according to this invention will have $H_2$ and CO mole ratios below 1, and even below 0.9, 0.8, or 0.7. However, because of the equal heats of combustion of $H_2$ and CO the heat of combustion of the synthesis gas produced will not be lower than that of a synthesis gas having higher ratios of $H_2$ to CO. Thus the high gasifier temperatures of this invention are advantageous in contributing to a high thermal efficiency by making possible oxidation of nearly all of the carbonaceous material in the gasifier, but the higher temperatures do not introduce a significant disadvantage with respect to the $H_2$ and CO ratio because of the use of much of the synthesis gas as fuel. In processes where all of the synthesis gas undergoes hydrogenative conversion, low ratios of $H_2$ to CO would constitute a considerable disadvantage.

The synthesis gas can be apportioned within the process on the basis of an aliquot or non-aliquot distribution of its $H_2$ and CO content. If the synthesis gas is to be apportioned on a non-aliquot basis, a portion of the synthesis gas can be passed to a cryogenic separator or to an adsorption unit to separate carbon monoxide from hydrogen. A hydrogen-rich stream is recovered and included in the make-up hydrogen stream to the liquefaction zone. A carbon monoxide-rich stream is recovered and blended with full range synthesis gas fuel containing aliquot quantities of $H_2$ and CO, or employed independently as process fuel.

Employment of a cryogenic or adsorption unit, or any other means, to separate hydrogen from carbon monoxide contributes to process efficiency since hydrogen and carbon monoxide exhibit about the same heat of combustion, but hydrogen is more valuable as a reactant than as a fuel. The removal of hydrogen from carbon monoxide is particularly advantageous in a process where adequate carbon monoxide is available to satisfy most of process fuel requirements. It is observed that removal of the hydrogen from the synthesis gas fuel can actually increase the heating value of the remaining carbon monoxide-rich stream. A synthesis gas stream having a heating value of 300 BTU/SCF (2,670 cal. kg/$M^3$) exhibited an enhanced heating value of 321 BTU/SCF (2,857 cal. kg/$M^3$) following removal of its hydrogen content. The capacity of the present process to interchangeably utilize full range synthesis gas or a carbon monoxide-rich stream as process fuel advantageously permits the recovery of the more valuable hydrogen component of synthesis gas without incurring a penalty in terms of degradation of the remaining carbon monoxide-rich stream. Therefore, the remaining carbon monoxide-rich stream can be utilized directly as process fuel without any upgrading step.

The manner in which the unexpected thermal efficiency advantage of this invention is achieved in a combination coal liquefaction-gasification process is explained in detail in relation to the graphical showing of FIG. 1. FIG. 1 shows that the thermal efficiency of a combination coal liquefaction-gasification process producing only liquid and gaseous fuels is higher than that of a gasification process alone. The superiority is maximized when the liquefaction zone produces an intermediate yield of normally solid dissolved coal, all of which is consumed in the gasification zone. The intermediate yield of normally solid dissolved coal is most easily achieved by employing slurry recycle due to the catalytic effect of minerals in the recycle slurry and due to the opportunity for further reaction of recycled dissolved coal. Therefore, the thermal efficiency of the present combination process would be lower than that of a gasification process alone if the severity of the liquefaction operation were so low and the amount of solid coal passed to the gasification plant were so high that the plant produced a great deal more hydrogen and synthesis gas fuel than it could consume, since that would be similar to straight gasification of coal. At the other extreme, if the severity of the liquefaction process were so high and the amount of solid coal passed to the gasification plant so low that the gasifier could not produce even the hydrogen requirement of the process (hydrogen production is the first priority of gasification), the shortage of hydrogen would have to be made up from another source. The only other practical source of hydrogen in the process would be steam reforming of the lighter gases, such as methane, or liquids from the liquefaction zone. However, this would constitute a decrease in overall efficiency since it would involve to a significant extent conversion of methane to hydrogen and back to methane again, and might also be difficult or impractical to accomplish.

The thermal efficiency of the combination process of this invention is calculated from the input and output energies of the process. The output energy of the process is equal to the high heating value (kilocalories) of all product fuels recovered from the process. The input energy is equal to the high heating value of the feed coal of the process plus the heating value of any fuel supplied to the process from an external source plus the heat required to produce purchased electric power. Assuming a 34 percent efficiency in the production of electric power, the heat required to produce purchased electric power is the heat equivalent of the electric power purchased divided by 0.34. The high heating value of the feed coal and product fuels of the process are used for calculations. The high heating value assumes that the fuel is dry and that the heat content of the water produced by reaction of hydrogen and oxygen is recovered via condensation. The thermal efficiency can be calculated as follows:

$$\text{Efficiency} = \frac{\text{ENERGY OUTPUT}}{\text{ENERGY INPUT}} = \frac{\text{heat content of all recovered product fuels}}{\left(\text{heat content of feed coal}\right) + \left(\text{heat content of any fuel supplied from outside the process}\right) + \left(\text{heat required to produce purchased electric power}\right)}$$

All of the raw feed coal for the process is pulverized, dried and mixed with hot solvent-containing recycle slurry. The recycle slurry is considerably more dilute than the slurry passed to the gasifier zone because it is not first vacuum distilled and contains a considerable quantity of 380° to 850° F. (193° to 454° C.) distillate liquid, which performs a solvent function. One to four parts, preferably 1.5 to 2.5 parts, on weight basis, of recycled slurry are employed to one part of raw coal. The recycled slurry, hydrogen and raw coal are passed through a fired tubular preheater zone, and then to a reactor or dissolver zone. The ratio of hydrogen to raw coal is in the range 20,000 to 80,000, and is preferably 30,000 to 60,000 SCF per ton (0.62 to 2.48, and is preferably 0.93 to 1.86 $M^3$/kg).

In the preheater the temperature of the reactants gradually increases so that the preheater outlet temperature is in the range 680° to 820° F. (360° to 438° C.), preferably about 700° to 760° F. (371° to 404° C.). The coal is partially dissolved at this temperature and exothermic hydrogenation and hydrocracking reactions are beginning. The heat generated by these exothermic reactions in the dissolver, which is well backmixed and is at a generally uniform temperature, raises the temperature of the reactants further to the range 800° to 900° F. (427° to 482° C.), preferably 840° to 870° F. (449° to 466° C.). The residence time in the dissolver zone is longer than in the preheater zone. The dissolver temperature is at least 20°, 50°, 100° or even 200° F. (11.1°, 27.8°, 55.5° or even 111.1° C.) higher than the outlet temperature of the preheater. The hydrogen pressure in the preheating and dissolver steps is in the range 1,000 to 4,000 psi, and is preferably 1,500 to 2,500 psi (70 to 280, and is preferably 105 to 175 kg/$cm^2$). The hydrogen is added to the slurry at one or more points. At least a portion of the hydrogen is added to the slurry prior to the inlet of the preheater. Additional hydrogen may be added between the preheater and dissolver and/or as quench hydrogen in the dissolver itself. Quench hydrogen is injected at various points when needed in the dissolver to maintain the reaction temperature at a level which avoids significant coking reactions.

Since the gasifier is preferably pressurized and is adapted to receive and process a slurry feed, the vacuum tower bottoms constitutes an ideal gasifier feed and should not be subjected to any hydrocarbon conversion or other process step which will disturb the slurry in advance of the gasifier. For example, the VTB should not be passed through either a delayed or a fluid coker in advance of the gasifier to produce coker distillate therefrom because the coke produced will then require slurrying in water to return it to acceptable condition for feeding to the gasifier. Gasifiers adapted to accept a solid feed require a lock hopper feeding mechanism and therefore are more complicated than gasifiers adapted to accept a slurry feed. The amount of water required to prepare an acceptable and pumpable slurry of coke is much greater than the amount of water that should be fed to the gasifier of this invention. The slurry feed to the gasifier of this invention is essentially water-free, although controlled amounts of water or steam are charged to the gasifier independently of the slurry feed to produce CO and $H_2$ by an endothermic reaction. This reaction consumes heat, whereas the reaction of carbonaceous feed with oxygen to produce CO generates heat. In a gasification process wherein $H_2$ is the preferred gasifier product, rather than CO, such as where a shift reaction, a methanation reaction, or a methanol conversion reaction will follow, the introduction of a large amount of water would be beneficial. However, in the process of this invention, where a considerable quantity of synthesis gas is utilized as process fuel, the production of hydrogen is of diminished benefit as compared to the production of CO, since $H_2$ and CO have about the same heat of combustion. Therefore, the gasifier of this invention can operate at the elevated temperatures indicated below in order to encourage nearly complete oxidation of carbonaceous feed even though these high temperatures induce a synthesis gas product with a mole ratio of $H_2$ to CO of less than one; preferably less than 0.8 or 0.9; and more preferably less than 0.6 or 0.7.

Because gasifiers are generally unable to oxidize all of the hydrocarbonaceous fuel supplied to them and some is unavoidably lost as coke in the removed slag, gasifiers tend to operate at a higher efficiency with a hydrocarbonaceous feed in the liquid state than with a solid carbonaceous feed, such as coke. Since coke is a solid degraded hydrocarbon, it cannot be gasified at as near to a 100 percent efficiency as a liquid hydrocarbonaceous feed so that more is lost in the molten slag formed in the gasifier than in the case of a liquid gasifier feed, which would constitute an unnecessary loss of carbonaceous material from the system. Whateven the gasifier feed, enhanced oxidation thereof is favored with increasing gasifier temperatures. Therefore, high gasifier temperatures are required to achieve the high process thermal efficiency of this invention. The maximum gasifier temperatures of this invention are in the range 2,200° to 3,600° F. (1,204° to 1,982° C.), generally; 2,300° to 3,200° F. (1,260° to 1,760° C.), preferably; and 2,400° or 2,500° to 3,200° F. (1,316° or 1,371° to 1,760° C.), most preferably. At these temperatures, the mineral residue is converted to molten slag which is removed from the bottom of the gasifier.

The employment of a coker between the dissolver zond and the gasifier zone would reduce the efficiency of the combination process. A coker converts normally solid dissolved coal to distillate fuel and to hydrocarbon gases with a substantial yield of coke. The dissolve zone also converts normally solid dissolved coal to distillate fuel and to hydrocarbon gases, but at a lower temperature and with a minimal yield of coke. Since the dissolver zone alone can produce the yield of normally solid dissolved coal required to achieve optimal thermal efficiency in the combination process of this invention, no coking step is required between the liquefaction and gasification zones. The performance of a required reaction in a single process step with minimal coke yield is more efficient than the use of two steps. In accordance with this invention, the total yield of coke, which occurs only in the form of minor deposits in the dissolver is well under one weight percent, based on feed coal, and is usually less than one-tenth of one weight percent.

The liquefaction process produces for sale a significant quantity of both liquid fuels and hydrocarbon gases. Overall process thermal efficiency is enhanced by employing process conditions adapted to produce significant quantities of both hydrocarbon gases and liquid fuels, as compared to process conditions adapted to force the production of either hydrocarbon gases or liquids, exclusively. For example, the liquefaction zone should produce at least 8 or 10 weight percent of $C_1$ to $C_4$ gaseous fuels, and at least 15 to 20 weight percent of 380° to 850° F. (193° to 454° C.) distillate liquid fuel, based on feed coal. A mixture of methane and ethane is recovered and sold as pipeline gas. A mixture of propane and butane is recovered and sold as LPG. Both of these products are premium fuels. Fuel oil boiling in the range 380° to 850° F. (193° to 454° C.) recovered from the process is a premium boiler fuel. It is essentially free of mineral matter and contains less than about 0.4 or 0.5 weight percent of sulfur. The $C_5$ to 380° F. (193° C.) naphtha stream can be upgraded to a premium gasoline fuel by pretreating and reforming. Hydrogen sulfide is recovered from process effluent in an acid gas removal system and is converted to elemental sulfur.

The advantage of the present invention is illustrated by FIG. 1 which shows a thermal efficiency curve for a combination coal liquefaction-gasification process performed with a Kentucky bituminous coal using dissolver temperatures between 800° and 860° F. (427° and 460° C.) and a dissolver hydrogen pressure of 1700 psi (119 kg/cm$^2$). The dissolver temperature is higher than the maximum preheater temperature. The liquefaction zone is supplied with raw coal at a fixed rate and mineral residue is recycled in slurry with distillate liquid solvent and normally solid dissolved coal at a rate which is fixed to maintain the total solids content of the feed slurry at 48 weight percent, which is close to a constraint solids level for pumpability, which is about 50 to 55 weight percent.

FIG. 1 relates the thermal efficiency of the combination process to the yield of 850° F.+ (454° C.+) dissolved coal, which is solid at room temperature and which together with mineral residue, which contains undissolved organic matter, comprises the vacuum tower bottoms obtained from the liquefaction zone. This vacuum tower bottoms is the only carbonaceous feed to the gasification zone and is passed directly to the gasification zone without any intervening treatment. The amount of normally solid dissolved coal in the vacuum tower bottoms can be varied by changing the temperature, hydrogen pressure or residence time in the dissolver zone or by varying the ratio of feed coal to recycle mineral residue. When the quantity of 850° F.+ (454° C.+) dissolved coal in the vacuum tower bottom changes, the composition of the recycle slurry automatically changes. Curve A is the thermal efficiency curve for the combination liquefaction-gasification process; curve B is the thermal efficiency for a typical gasification process alone; and point C represents the general region of maximum thermal efficiency of the combination process, which is about 72.4 percent in the example shown.

The gasification system of curve B includes an oxidation zone to produce synthesis gas, a shift reactor and acid gas removal unit combination to convert a portion of the synthesis gas to a hydrogen-rich stream, a separate acid gas removal unit to purify another portion of the synthesis gas for use as a fuel, and a shift reactor and methanizer combination to convert any remaining synthesis gas to pipeline gas. Thermal efficiencies for gasification systems including an oxidation zone, a shift reactor and a methanizer combination commonly range between 50 and 65 percent, and are lower than thermal efficiencies for liquefaction processes having moderate yields of normally solid dissolved coal. The oxidizer in a gasification system produces synthesis gas as a first step. As indicated above, since synthesis gas contains carbon monoxide it is not a marketable fuel and requires a hydrogenative conversion such as a methanation step or a methanol conversion for upgrading to a marketable fuel. Carbon monoxide is not only toxic, but it has a low heating value so that transportation costs for synthesis gas are unacceptable on a heating value basis. The ability of the present process to utilize all, or at least 60 percent of the combustion heat value of the $H_2$ plus CO content of the synthesis gas produced as fuel within the plant without hydrogenative conversion contributes to the elevated thermal efficiency of the present combination process.

In order for the synthesis gas to be utilized as a fuel within the plant in accordance with this invention conduit means must be provided to transport the synthesis gas or a non-aliquot portion of the CO content thereof to the liquefaction zone, following acid gas removal, and the liquefaction zone must be equipped with combustion means adapted to burn the synthesis gas or a carbon monoxide-rich portion thereof as fuel without an intervening synthesis gas hydrogenation unit. If the amount of synthesis gas is not sufficient to provide th full fuel requirement of the process, conduit means should also be provided for the transport of other fuel produced within the dissolver zone, such as naphtha, LPG, or gaseous fuels such as methane or ethane, to combustion means within the process adapted to burn said other fuel.

FIG. 1 shows that the thermal efficiency of the combination process is so low at 850° F.+ (454° C.+) dissolved coal yields above 45 percent that there is no efficiency advantage relative to gasification alone in operating a combination process at such high yields of normally solid dissolved coal. As indicated in FIG. 1, the absence of recycle mineral residue to catalyze the liquefaction reaction in a liquefaction process induces a yield of 850° F.+ (454° C.+) dissolved coal in the region of 60 percent, based on feed coal. FIG. 1 indicates that with recycle of mineral residue the yield of 850° F.+ (454° C.+) dissolved coal is reduced to the region of 20 to 25 percent, which corresponds to the region of maximum thermal efficiency for the combination process. With recycle of mineral residue a fine adjustment in the yield of 850° F.+ (454° C.+) dissolved coal in order to optimize thermal efficiency can be accomplished by varying the temperature, hydrogen pressure, residence time and/or the ratio of recycle slurry to feed coal while maintaining a constant solids level in the feed slurry.

Point $D_1$ on curve A indicates the point of chemical hydrogen balance for the combination process. At an 850° F.+ (454° C.+) dissolved coal yield of 15 percent (point $D_1$), the gasifier produces the exact chemical hydrogen requirement of the liquefaction process. The thermal efficiency at the 850° F.+ (454° C.+) dissolved coal yield of point $D_1$ is the same as the efficiency at the larger 850° F.+ (454° C.+) dissolved coal yield of point $D_2$. When operating the process in the region of the lower yield of point $D_1$, the dissolver zone will be relatively large to accomplish the requisite degree of hydrocracking and the gasifier zone will be relatively small because of the relatively small amount of carbonaceous material which is fed to it. When operating the process in the region of point $D_2$, the dissolver zone will be relatively small because of the reduced amount of hydrocracking required at point $D_2$, but the the gasifier zone will be relatively large. In the region between points $D_1$ and $D_2$ the dissolver zone and the gasifier zone will be relatively balanced and the thermal efficiency will be near a maximum.

Point $E_1$ on curve A indicates the point of process hydrogen balance, which includes hydrogen losses in the process. Point $E_1$ indicates the amount of 850° F.+ (454° C.+) dissolved coal that must be produced and passed to the gasifier zone to produce sufficient gaseous hydrogen to satisfy the chemical hydrogen requirement of the process plus losses of gaseous hydrogen in product liquid and gaseous streams. The relatively large amount of 850° F.+ (454° C.+) dissolved coal produced at point $E_2$ will achieve the same thermal efficiency as is achieved at point $E_1$. At the conditions of point $E_1$, the size of the dissolver will be relatively large to accomplish the greater degree of hydrocracking required at that point, and the size of the gasifier will be correspondingly relatively small. On the other hand, at the conditions of point $E_2$ the size of the dissolver will be relatively small because of the lower degree of hydrocracking, while the size of the gasifier will be relatively large. The dissolver and gasifier zones will be relatively balanced in size midway between points $E_1$ and $E_2$ (i.e. midway between 850° F.+ (454° C.+) coal yields of about 17.5 and 27 weight percent), and thermal efficiencies are the highest in this intermediate zone.

At point X on line $E_1E_2$, the yield of 850° F.+ (454° C.+) dissolved coal will be just adequate to supply all process hydrogen requirements and all process fuel requirements. At 850° F.+ (454° C.+) dissolved coal yields between points $E_1$ and X, all synthesis gas not required for process hydrogen is utilized as fuel within the process so that no hydrogenative conversion of synthesis gas is required and the thermal efficiency is high. However, at 850° F.+ (454° C.+) dissolved coal yields in the region between points X and $E_2$, the 850° F.+ (454° C.+) dissolved coal produced in excess of point X cannot be consumed within the process and therefore will require further conversion, such as methanation for sale as pipeline gas.

FIG. 1 shows that the thermal efficiency of the combination process increases as the amount of synthesis gas available for fuel increases and reaches a peak in the region of point Y, where the synthesis gas produced just supplies the entire process fuel requirement. The efficiency starts to decline at point Y because more synthesis gas is produced than the process can utilize as plant fuel and because it is at point Y that a methanation unit is required to convert the excess synthesis gas to pipeline gas. FIG. 1 shows that the improved thermal efficiencies of this invention are achieved when the amount of 850° F.+ (454° C.+) dissolved coal produced is adequate to produce any amount, for example, from about 5, 10 or 20 up to about 90 or 100 percent of process fuel requirements. However, FIG. 1 indicates that the thermal efficiency advantage of this invention still prevails, albeit to a diminished extent, when most of the synthesis gas produced is utilized without methanation to supply process fuel requirements, although a limited excess amount of synthesis gas is produced which requires methanation to render it marketable. When the amount of synthesis gas produced which requires methanation becomes excessive, as indicated at point Z, the efficiency advantage of this invention is lost. It is significant to note that a one percent efficiency increase in a commercial size plant of this invention can effect an annual savings of about ten million dollars.

The liquefaction process should operate at a severity so that the percent by weight of 850° F.+ (454° C.+) normally solid dissolved coal based on dry feed coal will be at any value between 15 and 45 percent, broadly; between 15 and 30 percent, less broadly; and between 17 and 27 percent; narrowly, which provides the thermal efficiency advantage of this invention. As stated above, the percent on a heating value basis of the total energy requirement of the process which is derived from the synthesis gas produced from these amounts of gasifier feeds should be at least 5, 10, 20 or 30 percent on a heating value basis, up to 100 percent; the remainder of the process energy being derived from fuel produced directly in the liquefaction zone and/or from energy supplied from a source outside of the process, such as electrical energy. It is advantageous that the portion of the plant fuel which is not synthesis gas be derived from the liquefaction process rather than from raw coal, since the prior treatment of the coal in the liquefaction process permits extraction of valuable fractions therefrom at the elevated efficiency of the combination process.

As shown above, high thermal efficiencies are associated with moderate yields of normally solid dissolved coal which, in turn, are associated with moderate liquefaction conditions. At moderate conditions, significant yields of hydrocarbon gases and liquid fuels are produced in the liquefaction zone and very high and very low yields of normally solid dissolved coal are discouraged. As indicated, the moderate conditions which result in a relatively balanced mix of hydrocarbon gases, liquid and solid coal liquefaction zone products require a plant wherein the sizes of the dissolver and gasifier zones are reasonably balanced, with both zones being of intermediate size. When the sizes of the dissolver and gasifier zones are reasonably balanced the gasifier will produce more synthesis gas than is required for process hydrogen requirements. Therefore, a balanced process requires a plant in which means are provided for passage of a stream of synthesis gas after acid gas removal to the liquefaction zone or elsewhere in the process at one or more sites therein which are provided with burner means for combustion of said synthesis gas or a carbon monoxide-rich portion thereof as plant fuel. In general, a different type of burner will be required for the combustion of synthesis gas or carbon monoxide than is required for the combustion of hydrocarbon gases. It is only in such a plant that optimal thermal efficiency can be achieved. Therefore, such a plant feature is critical if a plant is to embody the thermal efficiency optimization discovery of this invention.

A moderate and relatively balanced operation as described is obtained most readily by allowing the dissolver to achieve the reaction equilibrium it tends to favor, without imposing either reaction restraints or excesses. For example, hydrocracking reactions should not proceed to an excess such that very little or no normally solid dissolved coal is produced. On the other hand, hydrocracking reactions should not be unduly restrained, because a sharply reduced efficiency will result with very high yields of normally solid dissolved coal. Since hydrocracking reactions are exothermic, the temperature in the dissolver should be allowed to naturally rise above the temperature of the preheater. As indicated above, the prevention of such a temperature increase would require the introduction of considerably more quench hydrogen than is required with such a temperature increase. This would reduce thermal efficiency by requiring manufacture of more hydrogen than would be otherwise required and also would require the expenditure of additional energy to pressurize the excess hydrogen. Avoidance of a temperature differential developing between the preheater and dissolver zones might be achieved by a temperature increase in the preheater zone to cancel any temperature differential developing between the preheater and dissolver zones, but this would require excess fuel usage in the preheater zone. Therefore, it is seen that any expedient which maintained a common preheater and dissolver temperature would operate against the natural tendency of the liquefaction reaction and would reduce the thermal efficiency of the process.

Mineral residue produced in the process constitutes a hydrogenation and hydrocracking catalyst and recycle thereof within the process to increase its concentration results in an increase in the rates of reactions which naturally tend to occur, thereby reducing the required residence time in the dissolver and/or reducing the required size of the dissolver zone. The mineral residue is suspended in product slurry in the form of very small particles 1 to 20 microns in size, and the small size of the particles probably enhances their catalytic activity. The recycle of catalytic material sharply reduces the amount of solvent required. Therefore, recycle of process mineral residue in slurry with distillate liquid solvent in an amount adequate to provide a suitable equilibrium catalytic activity tends to enhance the thermal efficiency of the process.

The catalytic and other effects due to the recycle of process mineral residue can reduce by about one-half or even more the normally solid dissolved coal yield in the liquefaction zone via hydrocracking reactions, as well as inducing an increased removal of sulfur and oxygen. As indicated in FIG. 1, a 20 to 25 percent 850° F.+ (454° C.+) coal yield provides essentially a maximum thermal efficiency in a combination liquefaction-gasification process. A similar degree of hydrocracking cannot be achieved satisfactorily by allowing the dissolver temperature to increase without restraint via the exothermic reactions occurring therein because excessive coking would result.

Use of an external catalyst in the liquefaction process is not equivalent to recycle of mineral residue because introduction of an external catalyst would increase process cost, make the process more complex and thereby reduce process efficiency, as contrasted to the use of an indiginous or in situ catalyst. Therefore, the present process does not require or employ an external catalyst.

As already indicated, the thermal efficiency optimization curve of FIG. 1 relates thermal efficiency optimization to the yield of normally solid dissolved coal specifically and requires that all the normally solid dissolved coal obtained, without any liquid coal or hydrocarbon gases, be passed to the gasifier. Therefore, it is critical that any plant which embodies the described efficiency optimization curve employ a vacuum distillation tower, preferably in association with an atmospheric tower, to accomplish a complete separation of normally solid dissolved coal from liquid coal and hydrocarbon gases. An atmospheric tower alone is incapable of complete removal of distillate liquid from normally solid dissolved coal. In fact, the atmospheric tower can be omitted from the process, if desired. If liquid coal is passed to the gasifier a reduced efficiency will result since, unlike normally solid dissolved coal, liquid coal is a premium fuel. Liquid coal consumes more hydrogen in its production than does normally solid dissolved coal. The incremental hydrogen contained in liquid coal would be wasted in the oxidation zone, and this waste would constitute a reduction in process efficiency.

Figure 2:
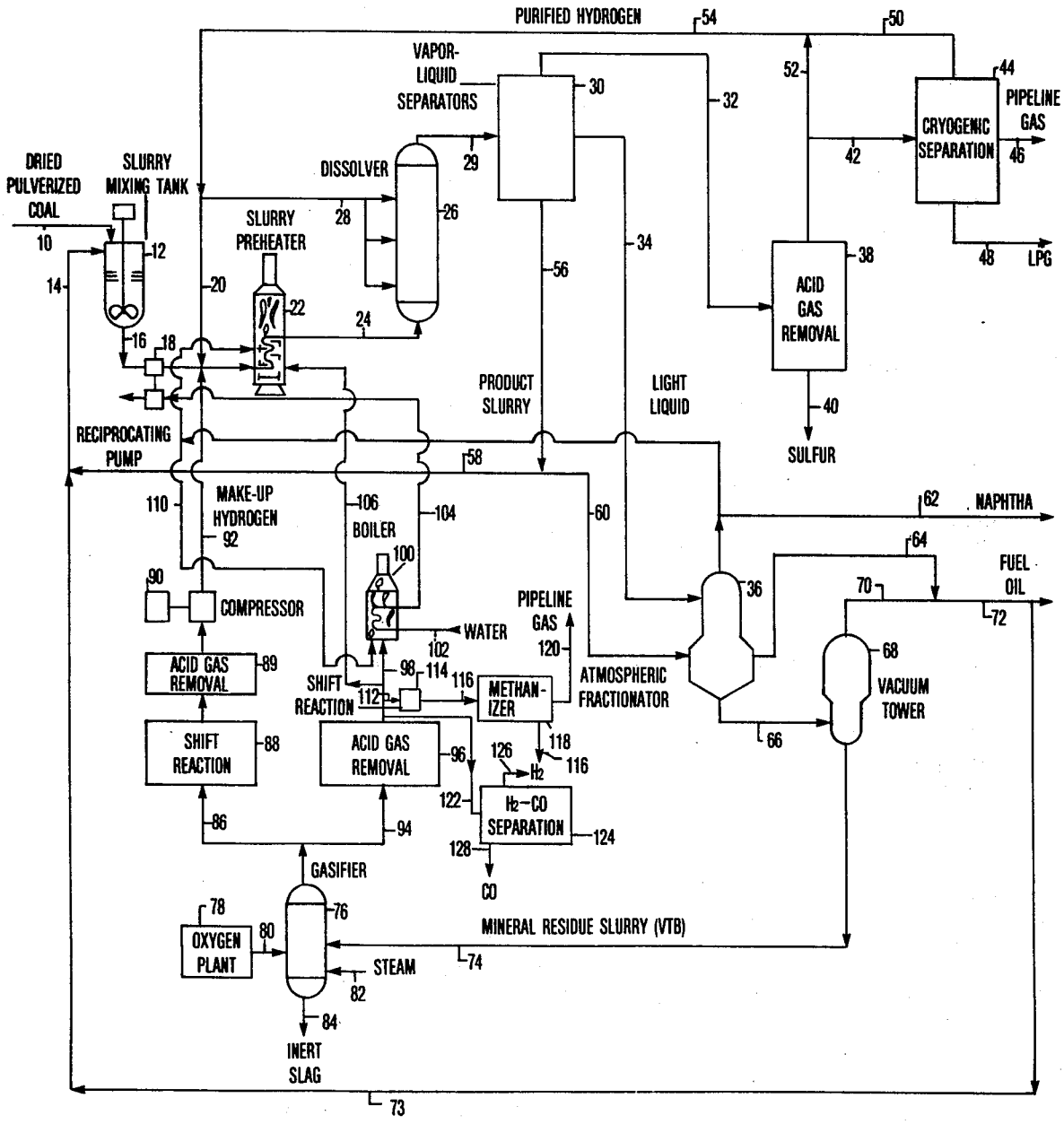

A scheme for performing the combination process of this invention is illustrated in FIG. 2. Dried and pulverized raw coal, which is the entire raw coal feed for the process, is passed through line 10 to slurry mixing tank 12 wherein it is mixed with hot solvent-containing recycle slurry from the process flowing in line 14. The solvent-containing recycle slurry mixture (in the range 1.5–2.5 parts by weight of slurry to one part of coal) in line 16 is pumped by means of reciprocating pump 18 and admixed with recycle hydrogen entering through line 20 and with make-up hydrogen entering through line 92 prior to passage through tubular preheater furnace 22 from which it is discharged through line 24 to dissolver 26. The ratio of hydrogen to feed coal is about 40,000 SCF/ton (1.24 $M^3$/kg).

The temperature of the reactants at the outlet of the preheater is about 700° to 760° F. (371° to 404° C.). At this temperature the coal is partially dissolved in the recycle solvent, and the exothermic hydrogenation and hydrocracking reactions are just beginning. Whereas the temperature gradually increases along the length of the preheater tube, the dissolver is at a generally uniform temperature throughout and the heat generated by the hydrocracking reactions in the dissolver raise the temperature of the reactants to the range 840°–870° F. (449°–466° C.). Hydrogen quench passing through line 28 is injected into the dissolver at various points to control the reaction temperature and alleviate the impact of the exothermic reactions.

The dissolver effluent passes through line 29 to vaporliquid separator system 30. The hot overhead vapor stream from these separators is cooled in a series of heat exchangers and additional vapor-liquid separation steps and removed through line 32. The liquid distillate from these separators passes through line 34 to atmospheric fractionator 36. The non-condensed gas in line 32 comprises unreacted hydrogen, methane and other light hydrocarbons, plus $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen (90 percent pure) in line 50 is blended with the remaining gas from the acid gas treating step in line 52 and comprises the recycle hydrogen for the process.

The liquid slurry from vapor-liquid separators 30 passes through line 56 and is split into two major streams, 58 and 60. Stream 58 comprises the recycle slurry containing solvent, normally dissolved coal and catalytic mineral residue. The non-recycled portion of this slurry passes through line 60 to atmospheric fractionator 36 for separation of the major products of the process.

In fractionator 36 the slurry product is distilled at atmospheric pressure to remove an overhead naphtha stream through line 62, a middle distillate stream through line 64 and a bottoms stream through line 66. The bottoms stream in line 66 passes to vacuum distillation tower 68. The temperature of the feed to the fractionation system is normally maintained at a sufficiently high level that no additional preheating is needed, other than for startup operations. A blend of the fuel oil from the atmospheric tower in line 64 and the middle distillate recovered from the vacuum tower through line 70 makes up the major fuel oil product of the process and is recovered through line 72. The stream in line 72 comprises 380°–850° F. (193°–454° C.) distillate fuel oil product and a portion thereof can be recycled to feed slurry mixing tank 12 through line 73 to regulate the solids concentration in the feed slurry and the coal-solvent ratio. Recycle stream 73 imparts flexibility to the process by allowing variability in the ratio of solvent to slurry which is recycled, so that this ratio is not fixed for the process by the ratio prevailing in line 58. It also can improve the pumpability of the slurry.

The bottoms from the vacuum tower, consisting of all the normally solid dissolved coal, undissolved organic matter and mineral matter, without any distillate liquid or hydrocarbon gases, is passed through line 74 to partial oxidation gasifier zone 76. Since gasifier 76 is adapted to receive and process a hydrocarbonaceous slurry feed stream, there should not be any hydrocarbon conversion step between vacuum tower 68 and gasifier 76, such as a coker, which will destroy the slurry and necessitate reslurrying in water. The amount of water required to slurry coke is greater than the amount of water ordinarily required by the gasifier so that the efficiency of the gasifier will be reduced by the amount of heat wasted in vaporizing the excess water. Nitrogen-free oxygen for gasifier 76 is prepared in oxygen plant 78 and passed to the gasifier through line 80. Steam is supplied to the gasifier through line 82. The entire mineral content of the feed coal supplied through line 10 is eliminated from the process as inert slag through line 84, which discharges from the bottom of gasifier 76. Synthesis gas is produced in gasifier 76 and a portion thereof passes through line 86 to shift reactor zone 88 for conversion by the shift reaction wherein steam and CO is converted to $H_2$ and $CO_2$, followed by an acid gas removal zone 89 for removal of $H_2S$ and $CO_2$. The purified hydrogen obtained (90 to 100 percent pure) is then compressed to process pressure by means of compressor 90 and fed through line 92 to supply make-up hydrogen for preheater zone 22 and dissolver 26. As explained above, heat generated within gasifier zone 76 is not considered to be a consumption of energy within the process, but merely heat of reaction required to produce a synthesis gas reaction product.

It is a critical feature of this invention that the amount of synthesis gas produced in gasifier 76 is sufficient not only to supply all the molecular hydrogen required by the process but also to supply, without a methanation step, between 5 and 100 percent of the total heat and energy requirement of the process. To this end, the portion of the synthesis gas that does not flow to the shift reactor passes through line 94 to acid gas removal unit 96 wherein $CO_2+H_2S$ are removed therefrom. The removal of $H_2S$ allows the synthesis gas to meet the environmental standards required of a fuel while the removal of $CO_2$ increases the heat content of the synthesis gas so that finer heat control can be achieved when it is utilized as a fuel. A stream of purified synthesis gas passes through line 98 to boiler 100. Boiler 100 is provided with means for combustion of the synthesis gas as a fuel. Water flows through line 102 to boiler 100 wherein it is converted to steam which flows through line 104 to supply process energy, such as to drive reciprocating pump 18. A separate stream of synthesis gas from acid gas removal unit 96 is passed through line 106 to preheater 22 for use as a fuel therein. The synthesis gas can be similarly used at any other point of the process requiring fuel. If the synthesis gas does not supply all of the fuel required for the process, the remainder of the fuel and the energy required in the process can be supplied from any non-premium fuel stream prepared directly within the liquefaction zone. If it is more economic, some or all of the energy for the process, which is not derived from synthesis gas, can be derived from a source outside of the process, not shown, such as from electric power.

Additional synthesis gas can be passed through line 112 to shift reactor 114 to increase the ratio of hydrogen to carbon monoxide from 0.6 to 3. This enriched hydrogen mixture is then passed through line 116 to methanation unit 118 for conversion to pipeline gas, which is passed through line 120 for mixing with the pipeline gas in line 46. The amount of pipeline gas based on heating value passing through line 120 will be less than the amount of synthesis gas used as process fuel passing through lines 98 and 106 to insure the thermal efficiency advantage of this invention.

A portion of the purified synthesis gas stream is passed through line 122 to a cryogenic separation unit 124 wherein hydrogen and carbon monoxide are separated from each other. An adsorption unit can be used in place of cyrogenic unit. A hydrogen-rich stream is recovered through line 126 and can be blended with the make-up hydrogen stream in line 92, independently passed to the liquefaction zone or sold as a product of the process. A carbon monoxide-rich stream is recovered through line 128 and can be blended with synthesis gas employed as process fuel in line 98 or in line 106, or can be sold or used independently as process fuel or as a chemical feedstock.

FIG. 2 shows that the gasifier section of the process is highly integrated into the liquefaction section. The entire feed to the gasifier section (VTB) is derived from the liquefaction section and all or most of the gaseous product of the gasifier section is consumed within the process, either as a reactant or as a fuel.

EXAMPLE 1

Raw Kentucky bituminous coal is pulverized, dried and mixed with hot recycle solvent-containing slurry from the process. The coal-recycle slurry mixture (in the range 1.5–2.5 parts by weight of slurry to one part of coal) is pumped, together with hydrogen, through a fired preheater zone to a dissolver zone. The ratio of hydrogen to coal is about 40,000 SCF/ton (1.24 $M^3$/kg).

The temperature of the reactants at the preheater outlet is about 700°–750° F. (371°–399° C.). At this point, the coal is partially dissolved in the recycle slurry, and the exothermic hydrogenation and hydrocracking reactions have just begun. The heat generated by these reactions in the dissolver zone further raises the temperature of the reactants to the range 820°–870° F. (438°–466° C.). Hydrogen quench is injected at various points in the dissolver to reduce the impact of the exothermic reactions.

The effluent from the dissolver zone passes through a product separation system, including an atmospheric and a vacuum tower. The 850° F.+ (454° C.+) residue from the vacuum tower, comprising all of the undissolved mineral residue plus all of the normally solid dissolved coal free of coal liquids and hydrocarbon gases goes to an oxygen-blown gasifier. The synthesis gas produced in the gasifier has a ratio of $H_2$ to CO of about 0.6 and goes through a shift reactor wherein steam and carbon monoxide are converted to hydrogen plus carbon dioxide, then to an acid gas removal step for removal of the carbon dioxide and hydrogen sulfide. The hydrogen (94 percent pure) is then compressed and fed as make-up hydrogen to the preheater-dissolver zones.

In this example, the amount of hydrocarbonaceous material fed to the gasification zone is sufficient so that the synthesis gas produced can satisfy process hydrogen requirements, including process losses, and about 5 percent of the total energy requirement of the process when burned directly in the process. The remaining energy requirement of the process is satisfied by the combustion of light hydrocarbon gases or naphtha produced in the liquefaction zone and by purchased electrical power.

Following is an analysis of the feed coal:

| Kentucky Bituminous Coal<br>Percent by weight (dry basis) | |
|---|---|
| Carbon | 71.5 |
| Hydrogen | 5.1 |
| Sulfur | 3.2 |
| Nitrogen | 1.3 |
| Oxygen | 9.6 |
| Ash | 8.9 |
| Moisture | — |

Following is a list of the products of the liquefaction zone. This list shows that the liquefaction zone produced both liquid and gaseous product, in addition to 850° F.+ (454° C.+) ashcontaining residue. The major product of the process is an ash-free fuel oil containing 0.3 weight percent sulfur which is useful in power plants and industrial installations.

| Yields from hydrogenation step (dissolver) | |
|---|---|
| Yields: percent by weight of dry coal | |
| $C_1$–$C_4$ gas | 16.2 |
| Naphtha; $C_5$–380° F. (193° C.) | 11.6 |
| Distillate fuel oil; 380°–850° F. (193°–454° C.) | 31.6 |
| Solid dissolved coal; 850° F.+ (454° C.+) | 17.7 |
| Undissolved organic material | 5.4 |
| Mineral matter | 9.3 |
| $H_2S$ | 2.1 |
| $CO + CO_2$ | 1.9 |
| $H_2O$ | 7.8 |
| $NH_3$ | 0.9 |
| Total | 104.5 |
| Hydrogen consumption: weight percent | 4.5 |

The following yields represent the products remaining for sale after deducting fuel requirements for a plant as indicated.

| Plant Product Yields | |
|---|---|
| Coal feed rate (dry basis): T/D(kg/D) | 30,000 (27.2 × $10^6$) |
| Products | |
| Pipeline gas: MM SCF/D (MM $M^3$/D) | 23.2 (0.66) |
| LPG: B/D ($M^3$/D)3 | 21,362 (2,563) |
| Naphtha: B/D ($M^3$/D) | 23,949 (2,874) |
| Distillate fuel oil: B/D ($M^3$/D) | 54,140 (6,497 |

The following data show the input energy, the output energy and the thermal efficiency of the combination process.

| Plant Thermal Efficiency | | |
|---|---|---|
| Input | MM BTU/D | MM cal. kg/D |
| Coal (30,000 T/D) (27.2 × $10^6$ kg/d) | 773,640 | 193,410 |
| Electrical power (132 megawatts)* | 31,600 | 7,900 |
| Total | 805,240 | 201,310 |
| Output | | |
| Pipeline gas(1) | 30,753 | 7,688 |
| LPG | 85,722 | 21,431 |
| Naphtha | 131,092 | 32,773 |
| Distillate fuel oil | 331,705 | 82,926 |
| Total | 579,272 | 144,818 |
| Thermal efficiency: percent | 71.9 | |

*Based on power plant thermal efficiency of 34 percent
(1)1,317 BTU/SCF (11,590 cal.kg/$M^3$)

This example shows that when the combination liquefaction-gasification process is operated so that the amount of hydrocarbonaceous material passed from the liquefaction zone to the gasifier zone is adequate to allow the gasifier to provide sufficient synthesis gas to satisfy process hydrogen requirements and only about 5 percent of total process energy requirements, the thermal efficiency of the combination process is 71.9 percent.

EXAMPLE 2

A combination liquefaction-gasification process is performed similar to the process of Example 1 and utilizing the same Kentucky bituminous feed coal except that the amount of hydrocarbonaceous material passed from the liquefaction zone to the gasification zone is adequate to enable the gasification zone to produce the entire process hydrogen requirement, including process losses, plus an amount of synthesis gas adequate to supply about 70 percent of the total energy requirement of the process when burned directly in the process.

Following is a list of the products of the liquefaction zone:

| Yields: percent by weight of dry coal | |
|---|---|
| $C_1$–$C_4$ gas | 12.8 |
| Naphtha; $C_5$–380° F. (193° C.) | 9.9 |
| Distillate fuel oil; 380°–850° F. (193°–454° C.) | 28.8 |
| Solid dissolved coal; 850° F.+ (454° C.+) | 25.3 |
| Undissolved organic material | 5.5 |
| Mineral matter | 9.3 |
| $H_2S$ | 2.0 |
| $CO + CO_2$ | 1.8 |
| $H_2O$ | 7.7 |
| $NH_3$ | 0.7 |
| Total | 103.8 |
| Hydrogen consumption | 3.8 |

The following yields represent the products remaining for sale after deducting process fuel requirements for a plant as indicated.

| Plant Product Yields | |
|---|---|
| Coal feed rate (dry basis): T/D(kg/D) | 30,000 (27.2 × $10^6$) |
| Products | |
| Pipeline gas: MM SCF/D (MM $M^3$/D) | 77 (2.16) |
| LPG: B/D ($M^3$/D)3 | 16,883 (2,026) |
| Naphtha: B/D ($M^3$/D) | 20,440 (2,453) |
| Distillate fuel oil: B/D ($M^3$/D) | 49,343 (5,921) |

The following data show the input energy, the output energy and the thermal efficiency of the process.

| Plant Thermal Efficiency | | |
|---|---|---|
| Input | MM BTU/D | MM cal.kg/D |
| Coal (30,000 T/D) (27.24 × $10^6$) | 773,640 | 193,410 |
| Electrical power (132 megawatts) | 31,600 | 7,900 |
| Total | 805,240 | 201,310 |
| Output | | |
| Pipeline gas(1) | 101,457 | 25,364 |
| LPG | 67,731 | 16,933 |
| Naphtha | 111,880 | 27,970 |
| Distillate fuel oil | 302,314 | 75,579 |
| Total | 583,382 | 145,846 |
| Thermal efficiency: Percent | 72.4 | |

(1)1,317 BTU/SCF (11,590 cal.kg/$M^3$)

The 72.4 percent thermal efficiency of this example is greater than the 71.9 percent thermal efficiency of Example 1, both examples using the same Kentucky bituminous feed coal, the difference being 0.5 percent. This shows that a higher thermal efficiency is achieved when the gasifier supplies the entire process hydrogen requirement plus 70 percent rather than 5 percent of the energy requirement of the process. It is noteworthy that in a commercial plant having the feed coal capacity of these examples a 0.5 percent difference in thermal efficiency represents an annual savings of about 5 million dollars.

EXAMPLE 3

A combination liquefaction-gasification process is performed similar to the process of Example 2 and utilizing the same Kentucky bituminous feed coal except that all the synthesis gas produced in excess of that required to satisfy process hydrogen requirements is methanated for sale. All process fuel is satisfied by $C_1$–$C_2$ gas produced in the liquefaction step.

Following is a list of the products of the liquefaction zone:

| Yields: percent by weight of dry coal | |
|---|---|
| $C_1$–$C_4$ gas | 12.8 |
| Naphtha; $C_5$–380° F. (193° C.) | 9.9 |
| Distillate fuel oil; 380°–850° F. (193°–454° C.) | 28.8 |
| Solid dissolved coal; 850° F.+ (454° C.+) | 25.3 |
| Undissolved organic material | 5.5 |
| Mineral matter | 9.3 |
| $H_2S$ | 2.0 |
| $CO + CO_2$ | 1.8 |
| $H_2O$ | 7.7 |
| $NH_3$ | 0.7 |
| Total | 103.8 |
| Hydrogen consumption | 3.8 |

The following yields represent the products remaining for sale after deducting fuel requirements for a plant as indicated.

| Plant Product Yields | |
|---|---|
| Coal feed rate (dry basis): T/D(kg/D) | 30,000 (27.2 × $10^6$) |
| Products | |
| Pipeline gas: MM SCF/D (MM $M^3$/D) | 78 (2.21) |
| LPG: B/D ($M^3$/D)3 | 16,883 (2,026) |
| Naphtha: B/D ($M^3$/D) | 20,440 (2,453) |
| Distillate fuel oil: B/D ($M^3$/D) | 49,343 (5,921) |

The following data show the input energy, the output energy and the thermal efficiency of the process.

| Plant Thermal Efficiency | | |
|---|---|---|
| Input | MM BTU/D | MM cal.kd/D |
| Coal (30,000 T/D) (27.2 × $10^6$) | 773,640 | 193,410 |
| Electrical power (132 megawatts) | 31,600 | 7,900 |
| Total | 805,240 | 201,310 |
| Output | | |
| Pipeline gas(1) | 81,472 | 20,368 |
| LPG | 67,731 | 16,933 |
| Naphtha | 111,880 | 27,970 |
| Distillate Fuel Oil | 302,314 | 75,579 |
| Total | 563,397 | 140,850 |
| Thermal efficiency: percent | 70.0 | |

(1)1,046 BTU/SCF (9,205 cal.kg/$M^3$)

While Examples 1 and 2 show thermal efficiencies of 71.9 and 72.4 percent when excess synthesis gas is produced beyond the amount required to satisfy process hydrogen requirements when the excess synthesis gas is utilized directly as plant fuel, the 70.0 percent thermal efficiency of the present example indicates a thermal efficiency disadvantage when excess synthesis gas is produced where the excess synthesis gas is upgraded via hydrogenation to a commercial fuel instead of being burned directly in the plant.

EXAMPLE 4

A combination liquefaction-gasification process is performed similar to the process of Example 1 except that the feed coal is a West Virginia Pittsburgh seam bituminous coal. The amount of hydrocarbonaceous material passed from the liquefaction zone to the gasification zone is adequate to enable the gasification zone to produce the entire process hydrogen requirement, including process losses, plus an amount of synthesis gas adequate to supply about 5 percent of the total energy requirement of the process when burned directly in the process.

Following is an analysis of the feed coal:

| West Virginia Pittsburgh Seam Coal Percent by weight (dry basic) | |
|---|---|
| Carbon | 67.4 |
| Hydrogen | 4.6 |
| Sulfur | 4.2 |
| Nitrogen | 1.2 |
| Oxygen | 7.5 |
| Ash | 15.1 |

Following is a list of the products of the liquefaction zone:

| Yields: percent by weight of dry coal | |
|---|---|
| $C_1$–$C_4$ | 17.5 |
| Naphtha; $C_5$–380° F. (193° C.) | 10.6 |
| Distillate fuel oil; 380°–850° F. (193°–454° C.) | 26.3 |
| Solid dissolved coal; 850° F.+ (454° C.+) | 18.0 |
| Undissolved organic matter | 6.8 |
| Mineral matter | 15.1 |
| $H_2S$ | 3.0 |
| $CO + CO_2$ | 1.2 |
| $H_2O$ | 5.7 |
| $NH_3$ | 0.5 |
| Total | 104.7 |
| Hydrogen consumption | 4.7 |

The following yields represent the products remaining for sale after deducting fuel requirements for a plant as indicated.

| Plant Product Yields | |
|---|---|
| Coal feed rate (dry basis): T/D (kg/D) | 30,000 (27.2 × $10^6$) |
| Products | |
| Pipeline gas: MM SCF/D (MM $M^3$/D) | 26.2 (0.74) |
| LPG: B/D ($M^3$/D)3 | 23,078 (2,769) |
| Naphtha: B/D ($M^3$/D) | 21,885 (2,626) |
| Distillate Fuel Oil: B/D ($M^3$/D) | 45,060 (5,407) |

The following data show the input energy, the output energy and the thermal efficiency of the combination process.

| Plant Thermal Efficiency | | |
|---|---|---|
| Input | MM BTU/D | MM cal.kg/D |
| Coal (30,000 T/D) (27.2 × $10^6$ kg/D) | 734,100 | 183,525 |
| Electrical power (132 megawatts) | 31,600 | 7,900 |
| Total | 765,700 | 191,425 |
| Output | | |
| Pipeline gas | 34,445 | 8,611 |
| LPG | 92,579 | 23,145 |
| Naphtha | 119,791 | 29,948 |
| Distillate fuel oil | 276,071 | 69,018 |
| Total | 522,886 | 130,722 |
| Thermal efficiency: percent | 68.3 | |

EXAMPLE 5

Another combination liquefaction-gasification process is performed similar to that of Example 4 using the same West Virginia Pittsburgh seam coal except that the amount of hydrocarbonaceous material passed from the liquefaction zone to the gasification zone is adequate to enable the gasification zone to produce the entire process hydrogen requirement plus an amount of synthesis gas adequate to supply about 37 percent of the energy requirement of the process when burned directly in the process.

Following is a list of the products of the liquefaction zone.

| Yields: percent by weight of dry coal | |
|---|---|
| $C_1$–$C_4$ gas | 16.0 |
| Naphtha; $C_5$–380° F. (193° C.) | 9.8 |
| Distillate fuel oil; 380°–850° F. (193°–454° C.) | 25.1 |
| Solid dissolved coal; 850° F.+ (454° C.+) | 21.7 |
| Undissolved organic matter | 6.5 |
| Mineral matter | 15.1 |
| $H_2S$ | 2.9 |
| $CO + CO_2$ | 1.3 |

-continued

| | | |
|---|---|---|
| $H_2O$ | | 5.4 |
| $NH_3$ | | 0.4 |
| | Total | 104.2 |
| Hydrogen consumption | | 4.2 |

The following yields represent the products remaining for sale after deducting fuel requirements for a plant as indicated.

| Plant Product Yields | |
|---|---|
| Coal feed rate (dry basis): T/D (kg/D) | 30,000 (27.2 × $10^6$) |
| Products | |
| Pipeline gas: MM SCF/D (MM $M^3$/D) | 64.8 (1.83 |
| LPG: B/D ($M^3$/D) | 18,338 (2,200) |
| Naphtha: B/D ($M^3$/D) | 20,233 (2,428) |
| Distillate fuel oil: B/D ($M^3$/D) | 43,004 (5,160) |

The following data show the input energy, the output energy and the thermal efficiency of the combination process.

| Plant Thermal Efficiency | | |
|---|---|---|
| Input | MM BTU/D | MM cal.kg/D |
| Coal (30,000 T/D) (27.2 × $10^6$) | 734,100 | 183,525 |
| Electrical power (132 megawatts) | 31,600 | 7,900 |
| Total | 765,700 | 191,425 |
| Output | | |
| Pipeline gas | 85,276 | 21,319 |
| LPG | 73,564 | 18,391 |
| Naphtha | 110,750 | 27,688 |
| Distillate fuel oil | 263,475 | 65,869 |
| Total | 573,065 | 133,267 |
| Thermal efficiency: percent | 69.6 | |

The thermal efficiency of this example is higher than the thermal efficiency of Example 4, both examples using the same Pittsburgh seam coal, the difference being 1.3 percent. The higher thermal efficiency of this example shows the advantage of supplying the gasifier with sufficient 850° F. + (454° C.+) dissolved coal to allow the gasifier to supply the entire process hydrogen requirement plus 37 rather than 5 percent of the energy requirement of the process by direct combustion of synthesis gas.

I claim:

1. A combination coal liquefaction-gasification process comprising passing mineral-containing feed coal, hydrogen, recycle dissolved liquid solvent, recycle normally solid dissolved coal and recycle mineral residue to a coal liquefaction zone to dissolve hydrocarbonaceous material from mineral residue and to hydrocrack said hydrocarbonaceous material to produce a mixture comprising hydrocarbon gases, dissolved liquid and normally solid dissolved coal and suspended mineral residue; separating distillate liquid and hydrocarbon gases from a slurry comprising said normally solid dissolved coal, solvent and mineral residue recycling to said liquefaction zone a portion of said slurry; passing the remainder of said slurry to distillation means including a vacuum distillation tower for distillation, the slurry bottoms from said vacuum distillation tower comprising a gasifier feed slurry; said gasifier feed slurry comprising substantially the entire normally solid dissolved coal and mineral residue yield of said liquefaction zone substantially without normally liquid coal and hydrocarbon gases; passing said gasifier feed slurry to a gasification zone; said gasifier feed slurry comprising substantially the entire hydrocarbonaceous feed to said gasification zone; injecting water or steam into said gasification zone; said gasification zone including an oxidation zone having a maximum temperature in the range 2,200° to 3,600° F. for conversion of the hydrocarbonaceous material therein to synthesis gas; said synthesis gas having a mol ratio of $H_2$ to CO of less than 1; converting a portion of said synthesis gas in a shift reaction to a first hydrogen-rich stream and passing said first hydrogen-rich stream to said liquefaction zone for use as process hydrogen; the amount of hydrocarbonaceous material passed to said gasification zone being sufficient to enable said gasification zone to produce an additional amount of synthesis gas beyond the amount required to produce process hydrogen which increases the thermal efficiency of said process when burned as fuel in said process; separating $H_2$ from CO in at least a portion of said additional amount of synthesis gas to provide a second hydrogen-rich stream and a carbon monoxide-rich stream; and burning as fuel in said process an amount comprising at least 60 mol percent of the total CO plus $H_2$ content of said additional amount of synthesis gas to supply between 5 and 100 percent on a heat basis of the total energy requirement of said process; said carbon monoxide-rich stream providing at least a portion of said fuel burned.

2. The process of claim 1 wherein a portion of said additional amount of synthesis gas is not subjected to said $H_2$ - CO separation step and is burned as fuel in said process.

3. The process of claim 1 wherein a portion of said additional amount of synthesis gas is converted to an other fuel.

4. The process of claim 1 wherein said second hydrogen-rich stream is passed to said coal liquefaction zone.

5. The process of claim 1 wherein the amount of normally solid dissolved coal in said gasifier feed slurry is between 15 and 45 weight percent of the feed coal.

6. The process of claim 1 wherein the amount of normally solid dissolved coal in said gasifier feed slurry is between 15 and 30 weight percent of the feed coal.

7. The process of claim 1 wherein the amount of normally solid dissolved coal in said gasifier feed slurry is between 17 and 27 weight percent of the feed coal.

8. The process of claim 1 including the removal of mineral residue as slag from said gasification zone.

9. The process of claim 1 wherein there is no step for the separation of mineral residue from normally solid dissolved coal.

10. The process of claim 1 wherein the maximum temperature in said gasification zone is between 2,300° and 3,600° F.

11. The process of claim 1 wherein the maximum temperature in said gasification zone is between 2,400° and 3,200° F.

12. The process of claim 1 wherein the maximum temperature in said gasification zone is between 2,500° and 3,600° F.

13. The process of claim 1 wherein the total coke yield in said liquefaction zone is less than 1 weight percent, based on feed coal.

14. The process of claim 2 wherein at least 70 mol percent of the CO plus $H_2$ content of said additional amount of synthesis gas is burned as fuel in said process.

15. The process of claim 1 wherein said gasifier feed slurry is essentially water-free.

16. The process of claim 1 wherein the mol ratio of $H_2$ to CO in said synthesis gas is less than 0.9.

17. The process of claim 1 wherein the mol ratio of $H_2$ to CO in said synthesis gas is less than 0.8.

18. The process of claim 3 wherein said other fuel is methane.

19. The process of claim 3 wherein said other fuel is methanol.

20. The process of claim 1 wherein said $H_2$ - CO separation step is a cryogenic step.

21. The process of claim 1 wherein said $H_2$ - CO separation step is an adsorption step.

* * * * *